US007530937B2

(12) United States Patent
Moody

(10) Patent No.: US 7,530,937 B2
(45) Date of Patent: May 12, 2009

(54) ENVELOPE PROCESSING EVALUATION GUIDE

(75) Inventor: Jay T. Moody, Wayland, MA (US)

(73) Assignee: Vistaprint Technologies Limited, Hamilton (BE)

( * ) Notice: Subject to any disclaimer, the term of this patent is extended or adjusted under 35 U.S.C. 154(b) by 0 days.

(21) Appl. No.: 11/481,108

(22) Filed: Jul. 5, 2006

(65) Prior Publication Data

US 2008/0009400 A1 Jan. 10, 2008

(51) Int. Cl.
*B31B 49/00* (2006.01)

(52) U.S. Cl. ..... 493/11; 493/34; 493/917

(58) Field of Classification Search ..... 493/917, 493/2, 3, 11, 23, 34, 194
See application file for complete search history.

(56) References Cited

U.S. PATENT DOCUMENTS 4,095,695 A * 6/1978 Steidinger ..... 229/314
4,223,882 A * 9/1980 Stocker ..... 493/11
4,578,052 A 3/1986 Engel et al.
4,744,509 A * 5/1988 Buchler-Dopheide ..... 229/92.1
5,152,122 A * 10/1992 DeBarber et al. ..... 53/460
5,685,816 A * 11/1997 Romer ..... 493/231
6,559,970 B1 * 5/2003 Yamamoto et al. ..... 358/1.18
6,635,003 B2 * 10/2003 Marchant ..... 493/231
2007/0085333 A1 * 4/2007 Stemmle ..... 283/61

* cited by examiner

*Primary Examiner*—Paul R Durand
(74) *Attorney, Agent, or Firm*—Robert L. Dulaney; Jessica J. Costa

(57) ABSTRACT

In a method and system for facilitating evaluation of the production accuracy of an envelope machine for producing folded envelopes from sheets of envelope stock, a guide of the same size as the envelope stock has indicia printed thereon corresponding to the locations of desired envelope folding operations. By processing a guide with the machine to form an envelope, the deviation of the actual folding location from the desired folding location can be evaluated by reference to the indicia and corrective machine adjustments can be made. Additional indicia printed on the guide facilitate further evaluation, such as accurate cutting of the envelope stock.

5 Claims, 4 Drawing Sheets

ENVELOPE PROCESSING EVALUATION GUIDE

FIELD OF THE INVENTION

This invention relates to the creation of folded envelopes.

BACKGROUND OF THE INVENTION

Systems capable of accepting stacks of cut sheets of paper, or other suitable envelope stock, and performing cutting, gluing, and folding operations are commercially available from various vendors, for example Winkler+Dünnebier AG. Many commercially available envelope machines are not limited to manufacturing a single size of envelope, but are designed to be flexible and adjustable to allow a single machine to be adjusted to create multiple different sizes of folded envelopes.

While these commercial systems are highly sophisticated and reliable, the transitioning of a machine from one envelope size to another typically requires several minutes of adjustments and "fine tuning" before the machine is performing the cutting and folding operations at an acceptable quality level. Similarly, after undergoing repair or maintenance procedures, the envelope machine may require adjustment before it is able to achieve the desired level of envelope production accuracy. To verify that the machine is producing envelopes properly, a number of test envelopes are typically processed and visually inspected by the machine operator. During this set up period, the machine is not being productive and is generating wasted envelope stock.

Envelopes with photographs, images, graphics, designs, and/or text printed on the front and back are in widespread use by individuals, professionals, organizations, and businesses. The envelope stock is printed on one side of an unfolded piece of paper or other material and then appropriately trimmed, folded, and glued as required to form the finished folded envelope. Envelopes with image content that is intended to stop exactly at a fold line and envelopes with image content on the back that is printed partially on the seal flap and partially on the bottom flap are not very forgiving of folding errors. Relatively minor folding problems that might be largely unnoticed on plain envelopes, are significantly more detectable in these types of envelopes, therefore, to ensure customer satisfaction with the finished envelope product, the machine operator may need to spend extra time and effort in getting the machine adjusted. Time spent in adjusting the machine increases the cost of doing business for the enveloper manufacturer. It is, therefore, highly desirable that envelope machines be adjusted to the proper folding performance as quickly and easily as possible.

There is, therefore, a need for a system and method capable of giving a quick and easily readable visual indication of the performance and accuracy of an envelope machine.

SUMMARY

The present invention is directed at satisfying the need for guides and processes that increase the ability of an operator to identify, evaluate, and correct envelope machine processing errors.

In accordance with one aspect of the invention, a processing evaluation guide has indicia indicating the desired location at which an envelope machine should perform at least folding operations. When the guide is processed into a folded envelope, the indicia provide visual cues regarding envelope machine processing accuracy.

In accordance with another aspect of the invention, after an envelope machine has been adjusted to prepare for producing envelopes, an evaluation guide having indicia indicating the desired location of desired fold locations is processing into an envelope and visually examined to compare the actual envelope fold locations with the desired locations. If the envelope is not satisfactory, the machine is adjusted as appropriate.

It is an advantage of the invention that the rapid identification and correction of envelope processing errors is facilitated.

It is another advantage of the invention that the time required to set up an envelope machine for production of envelopes is reduced.

These and other objects, features and advantages of the invention will be better understood with reference to the accompanying drawings, description and claims.

DETAILED DESCRIPTION

Figure 1:
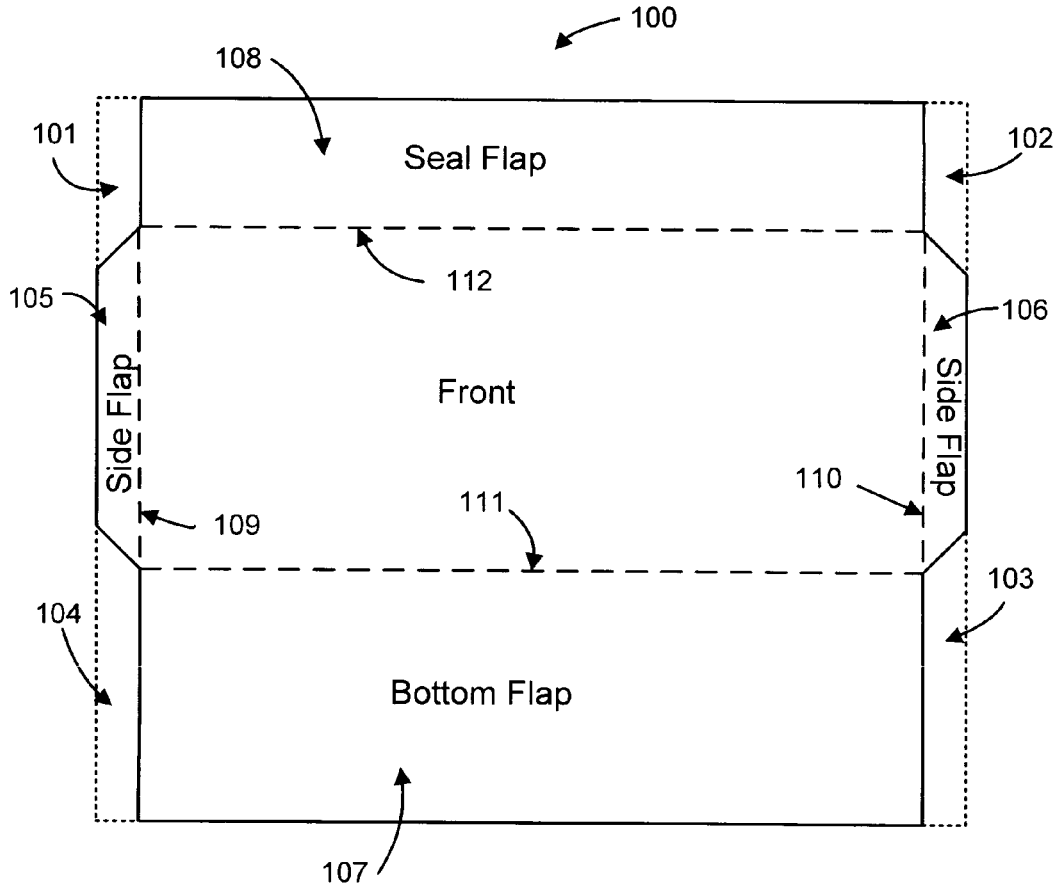
FIG. 1 illustrates the outside of an envelope prior to undergoing trimming, folding, and gluing.

FIG. 1 depicts sheet 100 prior to being processed into a finished envelope by trimming, gluing and folding. The envelope design and proportions depicted in FIG. 1 are merely representative for purposes of discussion. It will be understood by those of ordinary skill in the art that envelopes can be of various sizes, shapes, and materials and that the systems and methods disclosed herein are not limited to any particular envelope size, shape, material or trimming details. It will be further understood that envelopes are generally ordered in volume. In fulfilling an order for a requested quantity of custom envelopes, the appropriate number of sheets with the customer's desired images and other information are printed and fed into the envelope machine for processing into folded envelopes.

In processing sheet 100 into a finished envelope, the areas identified as 101-104 of sheet 100 are cut away and discarded. The removal of areas 101-104 creates side flaps 105 and 106, bottom flap 107 and seal flap 108. During processing of sheet 100 by the envelope machine, side flaps 105 and 106 will be folded along the lines indicated by dashed lines 109 and 110, bottom flap 107 will be folded along the line indicated by dashed line 111, and seal flap 108 will be folded along the line indicated by dashed line 112. Adhesive is applied to firmly attach back flap 107 to side flaps 105 and 106. For the typical envelope for business and consumer use, an appropriate adhesive is applied to the appropriate side of seal flap 108 to allow the user of the envelope to seal the envelope after the user's materials have been placed inside.

Figure 2:
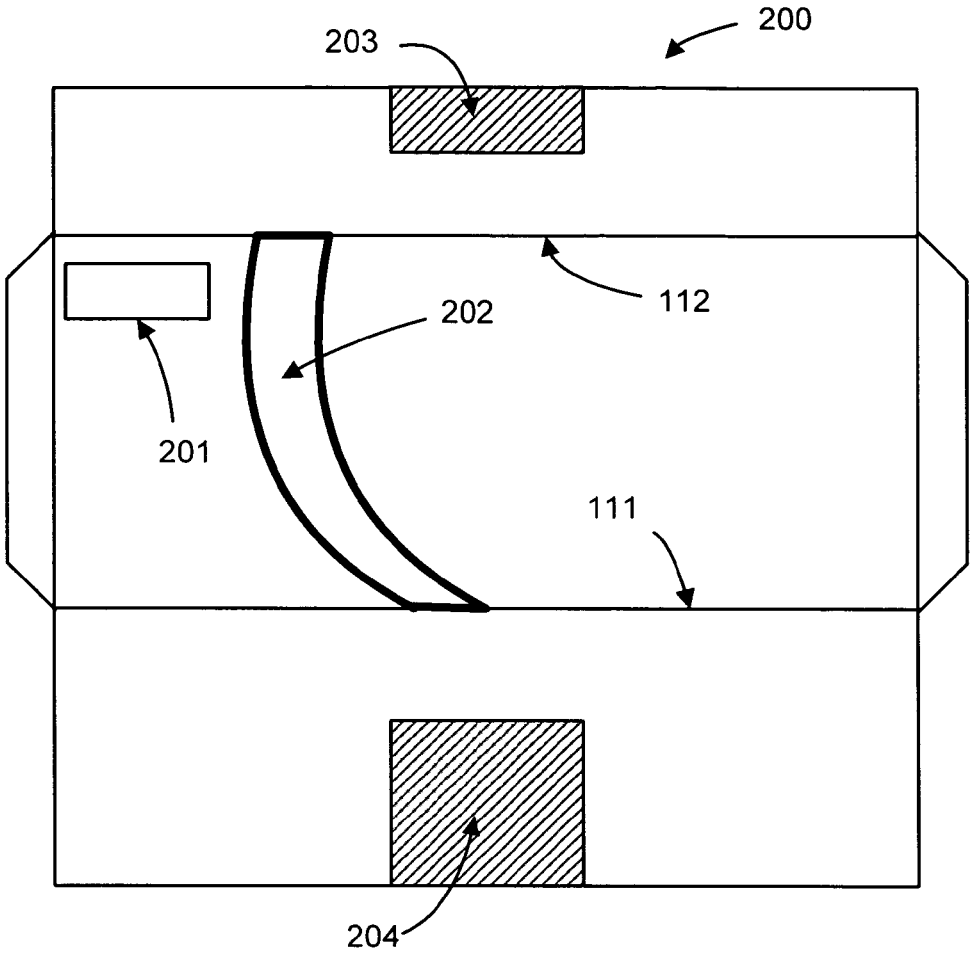
FIG. 2 illustrates the outside of an envelope after printing, but before undergoing trimming, folding and gluing.

FIG. 2 depicts sheet 200 which has been printed with images and other information and trimmed to remove the areas identified in FIG. 1 as 101-104. In this example, the area of sheet 200 that will be the front of the folded envelope has been printed with return address information 201 and image 202. Image 202 extends across the envelope front from the bottom fold line 111 to the top fold line 112. The area of sheet 200 that will become the seal flap has been printed with image 203. The area of sheet 200 that will become the bottom flap has been printed with image 204. Because some images, such as image 202, may be printed up to the intended fold line, it can be appreciated that the aesthetic appeal and perceived quality of envelopes printed in this fashion depends on the sheet being folded precisely.

Figure 3:
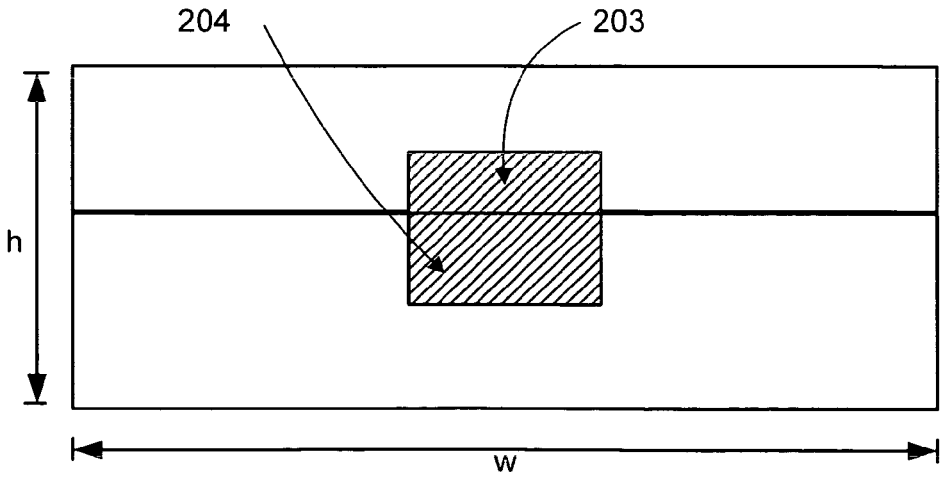
FIG. 3 illustrates the back of the folded envelope of FIG. 2.

FIG. 3 illustrates the back of a properly produced folded envelope produced from sheet 200. No part of image 202 is visible on the back of the envelope and images 203 and 204 are properly aligned.

Figure 4:
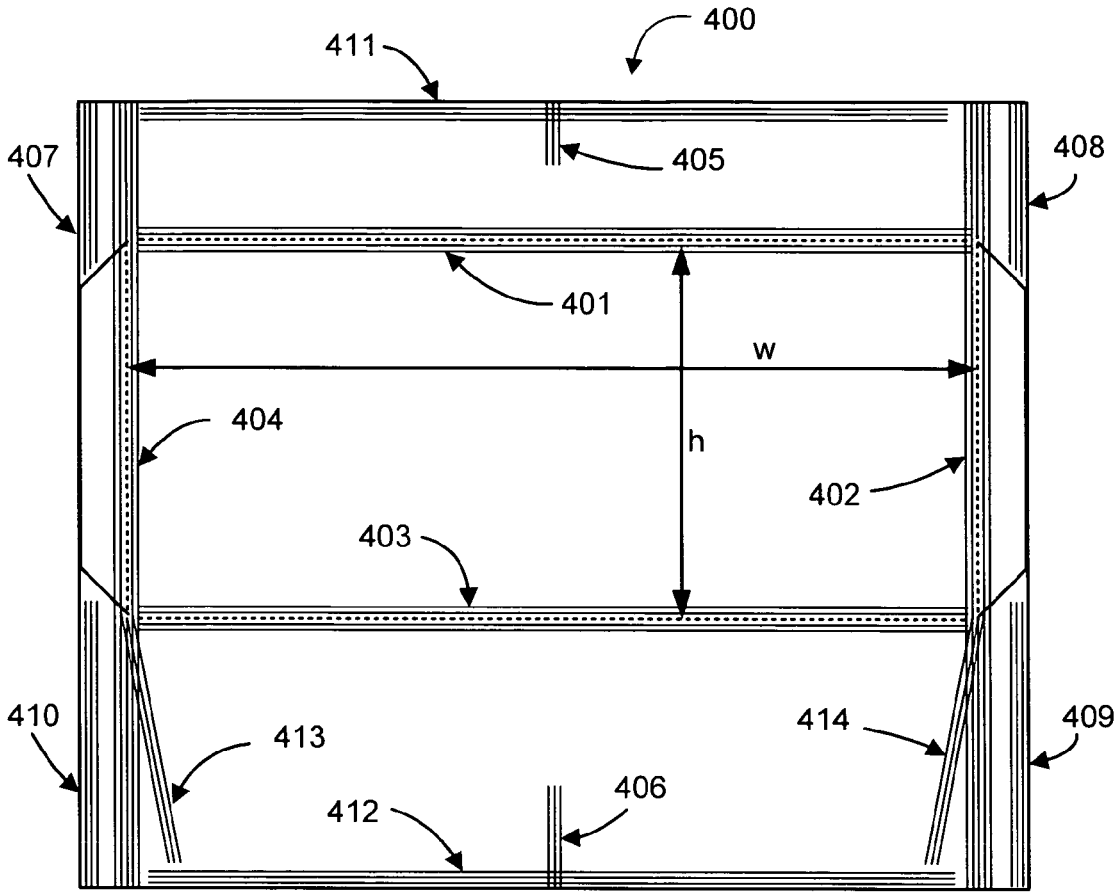
FIG. 4 is an illustrative envelope processing evaluation sheet.

FIG. 4 shows an illustrative example of a processing evaluation guide 400 for facilitating rapid identification and correction of folding and cutting issues. As discussed below, guide 400 is printed with indicia that enable the machine operator to quickly evaluate machine performance and accuracy. In the embodiment discussed herein, the indicia are a number of groups of parallel lines. Line group 401 is printed at the seal flap fold area, line groups 402 and 404 are printed at the side flap fold areas and line group 403 is printed at the bottom flap fold area. In each line group 401-404, the exact location of the desired fold line is indicated by a dotted line. In each of these line groups, on each side of the desired fold line, two additional lines are printed. Each line in a line group is separated from the adjacent lines in the line group by a relatively small distance, for example 1 millimeter. It will be understood that line groups with a different number of lines and with different spacing distances could be employed. To further facilitate quick readability, the lines in a line group could be printed in multiple different colors.

As another visual cue of processing accuracy, additional indicia could be printed on both the seal flap and at a corresponding position on the bottom flap such that, if the evaluation envelope has been properly processed, the indicia will align. In FIG. 4, line groups 405 and 406 are depicted for this purpose. If the evaluation envelope has been accurately processed, line group 405 will overlap and align with line group 406. It will be understood that multiple lines are not essential and other markings could be employed as these indicia.

An evaluation guide sheet is prepared to correspond to each envelope design with line groups positioned according to the required folding and other processing for that envelope. In this example, evaluation sheet 400 corresponds to the size of the envelope depicted in FIGS. 2 and 3. Line groups 401-404 are printed such that the dotted lines correspond to the desired envelope fold lines. When the envelope machine operator is preparing to begin processing envelopes in a situation where the accuracy of the folding process may be in doubt, such as after an envelope size change or after machine repair or maintenance, the operator can process one or more of the evaluation sheet sheets into folded envelopes and easily detect if the envelope was folded properly by visually examining whether the folds correspond to the dotted fold lines. Because evaluation sheet 400 is sized exactly like the corresponding envelope, it can be processed into a similar folded envelope. Any twisting, offset or other improper alignment will be readily apparent and the parallel lines having known spacing provide visual feedback on the degree of correction that is required to correct the problem. The evaluation sheet provides clear and consistent visual cues to assist the machine operator in fine tuning the envelope machine more quickly than if the operator were required to make machine adjustments based on plain paper stock or the customer's printed stock, which might not have suitable visual cues.

Figure 6:
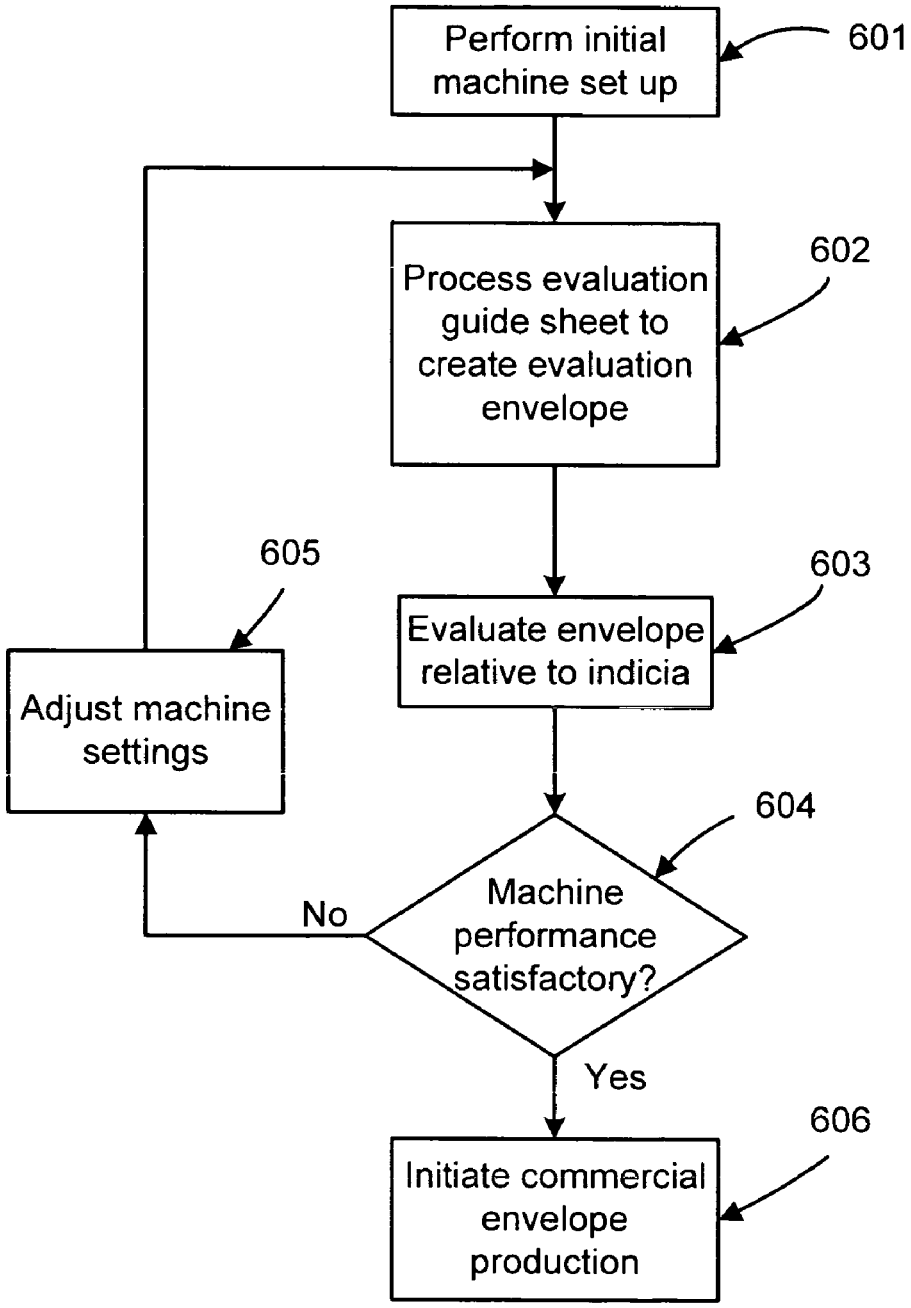
FIG. 6 shows a representative method employing evaluation sheets.

Referring to FIG. 6, an illustrative method for employing evaluation guide sheets is depicted. At step 601, the initial envelope machine set up is performed. At step 602, one or more evaluation sheets 400 corresponding to the size of the envelopes to be produced are fed into the envelope machine and processing into evaluation envelopes. At step 603, the machine operator evaluates the locations of the actual folds in the evaluation envelope produced from the evaluation sheet relative to the desired fold locations as indicated by the lines in line groups 401- 404. At step 604, if the folds made by the envelope machine are positioned satisfactorily to meet the envelope manufacturer's quality control requirements, the operator initiates commercial envelope production at step 606. However, if the folds are determined to be unsatisfactory at step 604, the operator will make one or more adjustment to the machine at step 605 to correct the particular problems indicated by the evaluation envelope.

Steps 602-605 are repeated as necessary until the evaluation envelope is satisfactory to the machine operator. While perfect processing is desirable, achieving it may not be possible or practical in all situations. The envelope manufacturer may, therefore, establish the criteria to be applied by the operator for determining an acceptable degree of processing accuracy and slight deviations in actual envelopes from the desired locations indicated on the guide sheet may be deemed commercially acceptable.

In the depicted embodiment, line groups 402 and 404 continue beyond the fold locations such that they extend over substantially the entire height of evaluation sheet 400. As discussed above, in processing the envelope stock, the machine will cut away the areas indicated in FIG. 1 as 101 -104. Providing line groups in the areas of these cuts provides visual cues to assist the operator in determining if improper cutting is occurring.

Figure 5:
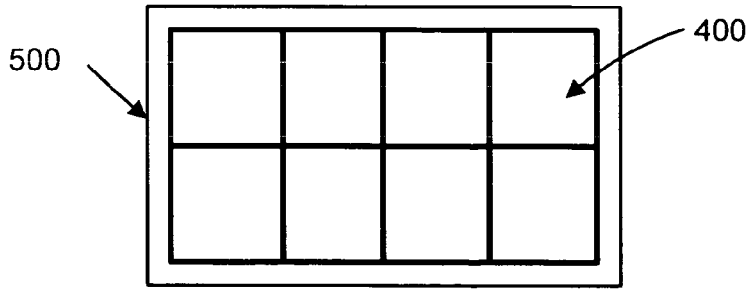
FIG. 5 shows an arrangement of multiple processing evaluation sheets.

In the disclosed embodiment, additional line groups are printed on evaluation sheet 400 for other quality verification functions. If the printing of the envelope stock occurred on a separate printing system, the stock may have undergone other cutting operations to trim away any excess paper. An evaluation sheet 400 having line groups 407-412 located around the sides as shown in FIG. 4 could be processed through the cutting system to provide visual cues of any improper cutting. For example, the envelope printer might gang multiple envelopes for simultaneously printing on large sheets of paper. In this situation, the large sheets would need to be cut to separate the individual print jobs. For example, referring to FIG. 5, a printer might choose gang eight envelope print jobs together for simultaneous printing on relatively large sheets of paper such as sheet 500. After printing the desired quantity of sheets 500, the stack of printed sheets must be cut to separate the sheets into stacks of individual envelope stock, such as 100 shown in FIG. 1. To check cutting accuracy, a sheet 500 preprinted with eight evaluation sheet sheets 400 in the same eight positions as the eight envelopes could be positioned on the top of the printed envelope sheets 500 prior to cutting. After cutting, operator examination of the line groups 407-412 of the evaluation sheet 400 on top of each stack of printed envelope stock would provide a visual indication of any cutting errors.

Yet other line groups could also be employed. For example, in many cases, the bottom flap of envelopes is not cut to be perfectly square, but is cut such that the bottom flap has a trapezoidal shape. Line groups 413 and 414 are printed along the line where the bottom flap is to be cut and allow quick verification that the bottom flap cutting is being performed properly. As yet another example, if the envelope is to be cut such that the seal flap has rounded corners instead of square corners, a group of appropriately curved lines, not shown, could be printed near the seal flap corners indicating this intended cut location.

While the use of evaluation guide sheets to facilitate the set up and adjustment of the envelope machine has been discussed, it will be appreciated that the guide sheets could also employed during production to check on machine performance. At regular or irregular intervals, as desired by the envelope manufacturer, a guide sheet could be introduced into the normal production flow. The resulting envelope could then be examined by a machine operator to verify that the machine is continuing to perform accurately. To facilitate operator recognition of the guide sheet, the sheet could have a distinctive color or bear distinctive markings or indicia such that it can be readily distinguished from regular production envelopes.

While an exemplary embodiment of the invention has been discussed, the described embodiment is to be considered as illustrative rather than restrictive. The scope of the invention is as indicated in the following claims and all equivalent methods and systems.

What is claimed is:

1. A method for evaluating the processing accuracy of an envelope machine capable of producing folded envelopes from sheets of envelope stock, the method comprising:

a) adjusting the envelope machine to prepare for producing envelopes of a known size and known processing requirements, b) processing at least one evaluation guide sheet with the envelope machine to create an envelope, the evaluation guide sheet being the same size as the envelope stock and having at least one or more line groups thereon, each line group comprising a first line corresponding to the desired location of an envelope fold and one or more additional lines parallel to the first line, c) evaluating the envelope produced from the evaluation guide sheet by at least visually comparing the location of one or more actual fold performed by the machine relative to the desired fold location indicated by the one or more line groups, and d) if the evaluation indicates that the envelope processing is not satisfactory, adjusting the machine as appropriate to adjust the machine performance.

2. The method of claim 1 further comprising repeating steps b)-d) as necessary until the envelope produced from the evaluation guide is folded satisfactorily.

3. The method of claim 1 wherein the envelope created by the machine has a seal nap and a bottom flap and wherein the envelope further has first indicia on the seal flap and second indicia on the bottom flap positioned such that the first and second indicia align when the envelope is processed accurately.

4. A method for evaluating the processing accuracy of an envelope machine producing folded envelopes from sheets of envelope stock, the method comprising:

a) including at least one evaluation guide sheet in the envelope stock to be processed by the machine, the evaluation guide sheet being the same size as the envelope stock and having at least one or more line groups thereon, each line group comprising a first line corresponding to the desired location of an envelope fold and one or more additional lines parallel to the first line, c) processing the evaluation guide sheet with the envelope machine to create an envelope, d) evaluating the envelope produced from the evaluation guide sheet by at least visually comparing the location of one or more actual fold performed by the machine relative to the desired fold location indicated by the one or more line groups, and e) if the evaluation indicates that the envelope processing is not satisfactory, adjusting the machine as appropriate to adjust the machine performance.

5. The method of claim 4 wherein the evaluation sheet has a distinctive appearance such that the envelope formed from the evaluation sheet can be distinguished from the envelopes formed from the other envelope stock.

* * * * *